US005415703A

United States Patent [19]

Ushigami et al.

[11] Patent Number: 5,415,703

[45] Date of Patent: May 16, 1995

[54] VERY THIN ELECTRICAL STEEL STRIP HAVING LOW CORE LOSS AND HIGH MAGNETIC FLUX DENSITY AND A PROCESS FOR PRODUCING THE SAME

[75] Inventors: Yoshiyuki Ushigami; Norito Abe; Sadami Kousaka; Tadao Nozawa; Osamu Honjo; Tadashi Nakayama, all of Kitayusyushi, Japan

[73] Assignee: Nippon Steel Corporation, Tokyo, Japan

[21] Appl. No.: 22,412

[22] Filed: Feb. 16, 1993

Related U.S. Application Data

[60] Division of Ser. No. 879,170, May 1, 1992, abandoned, which is a continuation of Ser. No. 453,993, Dec. 20, 1989, abandoned.

[30] Foreign Application Priority Data

Dec. 22, 1988 [JP] Japan ..... 63-322030

[51] Int. Cl.[6] ..... H01F 1/147

[52] U.S. Cl. ..... 148/308; 420/117

[58] Field of Search ..... 148/307, 308; 420/117

[56] References Cited

U.S. PATENT DOCUMENTS

| | | | |
|---|---|---|---|
| 1,965,559 | 7/1934 | Goss | 175/21 |
| 2,473,156 | 6/1949 | Littmann | 148/111 |
| 2,599,340 | 6/1952 | Littmann et al. | 148/12.5 |
| 3,287,183 | 11/1966 | Taguchi et al. | 148/111 |
| 3,932,234 | 1/1976 | Imanaka et al. | 148/112 |
| 4,579,608 | 4/1986 | Shimizu et al. | 148/308 |
| 4,692,193 | 8/1987 | Yoshitomi et al. | 148/308 |
| 5,305,411 | 5/1994 | Suga et al. | 148/308 |

FOREIGN PATENT DOCUMENTS

| | | | |
|---|---|---|---|
| 30-3651 | 5/1955 | Japan . | |
| 40-15644 | 7/1965 | Japan . | |
| 51-13469 | 4/1976 | Japan . | |
| 53-28375 | 8/1978 | Japan . | |
| 59-215419 | 12/1984 | Japan . | |
| 61-217526 | 9/1986 | Japan | 148/111 |
| 2104916 | 3/1983 | United Kingdom | 148/307 |

OTHER PUBLICATIONS

Honda et al., Sci. Reps., Tohoku Imp. Univ., 15 (1926), pp. 721–754.

Pry et al., Journal of Applied Physics, vol. 29, No. 3, Mar. 1958, pp. 532–533.

Chikazumi, Applied Physics, 53 (1984), pp. 291–295.

Takada et al., Journal of Applied Physics, vol. 64, No. 10, Nov. 1988, pp. 5367–5369.

Dunn, Acta Metallurgica, vol. 1, Mar. 1953, pp. 163–175.

Arai et al., Metallurgical Transactions, vol. 17A, Aug. 1986, pp. 1295–1299.

*Primary Examiner*—George Wyszomierski

*Attorney, Agent, or Firm*—Wenderoth, Lind & Ponack

[57] ABSTRACT

A very thin electrical steel strip having a thickness not exceeding 150 microns, an average grain diameter not exceeding 1.0 mm, a high degree of {110} <001> grain orientation, a high normalized magnetic flux density as expressed by a $B_8/B_s$ value which is greater than 0.9, and a low core loss not exceeding 50% of the core loss of any conventional product.

It is produced from a starting material consisting of a grain-oriented electrical steel strip containing not more than 8% silicon, the balance thereof substantially being iron, and having a high degree of {110} <001> grain orientation, a normalized magnetic flux density as expressed by a $B_8/B_s$ value which is greater than 0.9, an average grain diameter of at least 20 mm in the rolling direction and an average grain diameter of at least 40 mm in the direction perpendicular to the rolling direction. The material is cold rolled with a reduction of 60 to 80% to a final thickness not exceeding 150 microns, and the cold rolled material is annealed for primary recrystallization. The use of a starting material further containing 0.005 to 0.30% of one or both of tin and antimony yields a product of still improved properties.

1 Claim, 12 Drawing Sheets

(200) Pole Figuer

800°C × 2min.
(Average Grain Diameter 51μm)

800°C×2min.+1200°C×10hr.
(Average Grain Diameter 97μm)

VERY THIN ELECTRICAL STEEL STRIP HAVING LOW CORE LOSS AND HIGH MAGNETIC FLUX DENSITY AND A PROCESS FOR PRODUCING THE SAME

This application is a division of now abandoned application Ser. No. 07/879,170 filed May 1, 1992, which is a continuation of now abandoned application Ser. No. 07/453,993 filed Dec. 20, 1989.

TECHNICAL FIELD

This invention relates to a very thin electrical steel strip in which the grains or crystals have a <001> axis of easy magnetization lying in parallel to the rolling direction of the strip and the {110} plane of crystal lattice lying in parallel to the strip surface, i.e. a {110} <001> orientation as designated by Miller's Indices, and to a process for producing the same. The strip of this invention has a high magnetic flux density and a low core loss despite its small thickness, and is suitable for use in making high frequency power source transformers and control devices.

BACKGROUND ART

The basic concept of the magnetic properties of grain-oriented electrical steel sheets was studied for the first time when the magnetic anisotropy of a single crystal of iron was discovered in 1926 [K. Honda and S. Kaya: Sci. Reps., Tohoku Imp. Univ., 15 (1926), p. 721]. It has become possible to produce grain-oriented electrical steel strips having greatly improved magnetic properties since a process for producing a material having a {110} <001> texture was invented by N. P. Goss (U.S. Pat. No. 1,965,559).

The aggregation of the grains having a {110} <001> orientation in electrical steel strips is achieved by utilizing a catastrophic phenomenon of grain growth called secondary recrystallization. The control of secondary recrystallization essentially requires the control of a primary recrystallization texture and structure prior to the secondary recrystallization thereof and the control of an inhibitor, i.e. a fine precipitate, or an element of the intergranular segregation type. The inhibitor inhibits the growth of any grains Other than those having a {110} <001> orientation in the primary recrystallization texture and enables the selective growth of the grains having a {110} <001> orientation.

The following are the three typical processes which are known for the industrial manufacture of grain-oriented electrical steel strips or sheets:

(1) The process as disclosed by M. F. Littmann in U.S. Pat. No. 2,599,340 (Japanese Patent Publication No. 3651/1955) which employs two steps of cold rolling utilizing MnS as the inhibitor;

(2) The process as disclosed by Taguchi and Sakakura in U.S. Pat. No. 3,287,183 (Japanese Patent Publication No. 15644/1965) which adopts a reduction rate exceeding 80% in final cold rolling utilizing an inhibitor comprising AlN and MnS; and (3) The process as disclosed by Imanaka et al. in U.S. Pat. No. 3,932,234 (Japanese Patent Publication No. 13469/1976) which employs two steps of cold rolling utilizing an inhibitor comprising MnS (or MnSe) and Sb.

These processes have made it possible to produce on a commercial basis grain-oriented electrical steel Strips in which the grains having a {110} <001> orientation have so high a degree of sharpness that the strips have a magnetic flux density ($B_8$ value) of about 1.92 tesla. With a reduction of sheet thickness, however, the inhibitor exhibits a sensitive behavior of change through the interface which makes it difficult to produce thin grain-oriented electrical steel strips on an industrial basis. The main strips which are industrially available have, therefore, a thickness which is not smaller than 0.20 mm.

The core loss of grain-oriented electrical steel strips in a high frequency range increases in proportion to the square of their thickness, as reported by, for example, R. H. Pry and C. P. Bean in J. Appl. Phys., 29 (1958), p. 532. Therefore, it is essential to make a strip having a small thickness if it is desirable to obtain a sheet having a low core loss.

In 1949, M. F. Littmann disclosed a process for producing very thin silicon steel strip in U.S. Pat. No. 2,473,156. This process comprises cold rolling a starting material having a {110} <001> crystal orientation and subjecting it to a recrystallizing treatment, and does not use any inhibitor. The products of the process had a thickness of 1 to 5 mils (25.4 to 127 microns), a magnetic flux density ($B_8$ value) of 1.600 to 1.815 teslas, and a core loss of 0.26 to 0.53 W/lb. (0.44 to 0.90 W/kg) at a frequency of 60 Hz and a maximum magnetic flux density of 1.0 T. This process is still used for producing very thin electrical steel strips.

DISCLOSURE OF THE INVENTION

As a result of the remarkable development of electronic apparatus, demand has recently grown for smaller and more efficient high-frequency power source transformers and control devices. The conventionally available very thin electrical steel strip, however, has a low magnetic flux density, as hereinabove stated, which is so low as not to permit the selection of a sufficiently high design value of magnetic flux density to attain a satisfactory reduction in size of apparatus. Moreover, it has a very high core loss, particularly in a high excitation range.

The inventors of this invention have found that it is essential for a very thin electrical steel strip having a low core loss, particularly in a high excitation range, to employ a material having a silicon content not exceeding 8%, the balance thereof substantially being iron, and an average grain diameter not exceeding 1.0 mm, and to have a thickness not exceeding 150 microns and a $B_8/B_s$ (magnetic flux density/saturation magnetic flux density) value which is larger than 0.9. The inventors hereby propose an electrical steel strip satisfying those requirements and a process for producing it, which will hereinafter be described in detail.

Referring to the mechanism of magnetization which governs the core loss of an electrical material, it has hitherto been usual to consider the degree of sharpness in the crystal orientation of the material as an unimportant factor in a high frequency range, but to consider it more important to adopt another method, such as increasing the amount of silicon to raise the resistivity of the material, as is obvious from the following statement:

> "Although the movement of the magnetic domain walls plays a principal role in the process of static or low frequency magnetization, it is considered better in a high frequency range to achieve magnetization by domain rotation, since in a high frequency range, the domain walls are not only difficult to move, but also the movement thereof produces a loss of energy"

[Chikazumi: Applied Physics, 53 (1984), p. 294]. According to, for example, Y. Takada et al. who compare grain-oriented and non-oriented electrical steel strips and 6.5% Si-Fe in J. Appl. Phys., 64 (1988), pages 5367 to 5369, the grain-oriented electrical steel strip having a controlled crystal orientation shows the lowest core loss at a frequency of 50 Hz, but at a frequency of 10 kHz, 6.5% Si-Fe shows the lowest core loss and the grain-oriented and non-oriented electrical steel strips having a substantially equal silicon content do not show any appreciable difference in core loss from each other, and it is, therefore, ovbious that the crystal orientation does not have any substantial effect on core loss in a high frequency range (see Table 1).

TABLE 1

| | Thickness (mm) | $B_8$ (T) | Core loss (W/kg) $W_{10/50}$ | $W_{2/10k}$ |
|---|---|---|---|---|
| Grain-oriented electrical steel strip (3.2% Si) | 0.3 | 1.93 | 0.35 | >150 |
| Non-oriented electrical steel strip (3.0% Si) | 0.5 | 1.42 | 1.36 | 180 |
| 6.5% Si-Fe | 0.3 | 1.27 | 0.49 | 74 |
| " | 0.5 | 1.27 | 0.58 | 106 |

As a result of their research on very thin electrical steel strip used for making high-frequency power source transformers, control devices, etc., the inventors of this invention have found that a very thin electrical steel strip having a thickness not exceeding 150 microns, an average grain diameter not exceeding 1.0 mm and a normalized magnetic flux density $B_8/B_s$ value which is larger than 0.9 has a remarkably low core loss in a high frequency range.

FIG. 1(*a*) shows the relation between magnetic flux density and core loss which is measured at 1.5 T and 1000 Hz. It is obvious therefrom that the strip having a $B_8$ value which is equal to, or greater than, 1.85 teslas ($B_8/B_s>0.9$) has a low core loss in a high frequency range. FIG. 1(*b*) shows the relationship between core loss and frequency of very thin electrical steel sheets of this invention having a magnetic flux density or $B_8$ value of 1.94 T, which are shown by white circles, and that of conventional products having a $B_8$ value of 1.60 T, which are shown by black circles. It is obvious from it that a very thin electrical steel strip having a high magnetic flux density shows a low core loss in a high frequency range. A very thin electrical steel strip having a high magnetic flux density not only has a low core loss, but also allows for the choice of a high design value of magnetic flux density which enables a reduction in size of apparatus and a drastic improvement in characteristics of high-frequency power source transformers or control devices.

As a result of their research, the inventors have discovered that a very thin electrical steel strip containing not more than 8.0% by weight of silicon and 0.005 to 0.30% by weight of Sn or Sb, or both, the balance thereof substantially being iron, and having a thickness not exceeding 150 microns, an average grain diameter not exceeding 1.0 mm and a normalized magnetic flux density $B8/B_s$ value which is larger than 0.9, shows a very low core loss in a high frequency range.

Description will now be made of a process for producing such a very thin electrical steel strip.

The inventors considered that a reduction in thickness of an electrical steel strip would make it difficult to control an inhibitor and achieve stable secondary recrystallization, as hereinbefore stated, and studied the possibility of attaining a high degree of sharpness of grains having a {110} <001> orientation by primary recrystallization not employing any inhibitor. As a result, they have found that it is possible to produce a very thin electrical steel strip having an aggregation of grains having a sharp {110} <001> orientation, and a low core loss by employing a starting material comprising grain-oriented electrical steel having a very high degree of sharpness of grains having a {110} <001> orientation, cold rolling it to a final thickness not exceeding 150 microns, and subjecting it to primary recrystallization annealing, while inhibiting recrystallization from the grain boundary.

The inventors have found this based on the following experiment. They used as a starting material a grain-oriented electrical steel strip containing 3.3% Si, 0.002% C, 0.002% N, 0.002% Al, 0.0002% S and 0.13% Mn, all by weight, the balance thereof substantially being iron, and having a texture of grains having a {110} <001> orientation, a magnetic flux density ($B_8$ value) of 1.92 T, an average grain diameter of 40 mm and a thickness of 0.30 mm. The inventors cold rolled to a final thickness of 0.09 mm (90 microns) and annealed at 850° C. for 10 minutes to complete its primary recrystallization.

FIG. 2 shows the texture of the product obtained from the experiment. As is obvious therefrom, the grains of primary recrystallization include not only ones having a {110} <001> orientation, but also ones having a {111} <011> orientation, and an increase of the latter type of grains brings about a lowering of magnetic flux density.

The texture is definitely different from that obtained by the process disclosed by Littmann in U.S. Pat. No. 2,473,156, which has a {210} <001> to {310} <001> orientation. This is apparently due to the fact that the starting material employed by Littmann had a magnetic flux density or B10 value which was as low as 1.74 T, and a poor {110} <001> type. It, therefore, follows that the manufacture of a product having a high magnetic flux density requires the use of a starting material having a high degree of {110} <001> orientation and the inhibition of primary recrystallization of grains having a {111} <011> orientation. As a result of their research on the cold rolling and recrystallization of the starting material, the present inventors have found that the grains having a {110} <001> orientation nucleate and grow in the grains of the starting material, while the grains having a {111} <011> orientation nucleate and grow from the grain boundary (See FIGS. 10(*a*) and 10(*b*)).

This discovery teaches that it is possible to obtain a very thin product having a high degree of {110} <001> orientation by employing a starting material having a small grain boundary area, or inhibiting the occurrence of nuclei from the grain boundary.

BRIEF DESCRIPTION OF THE DRAWINGS

FIG. 1(*b*) is a graph showing the core losses of very thin electrical steel strips having different magnetic flux densities in relation to frequency;

FIG. 8(*b*) is a graph showing the core losses of products of this invention as compared with the conventional products at 400 Hz in relation to exciting flux density;

BEST MODE OF CARRYING OUT THE INVENTION

Figure 1:
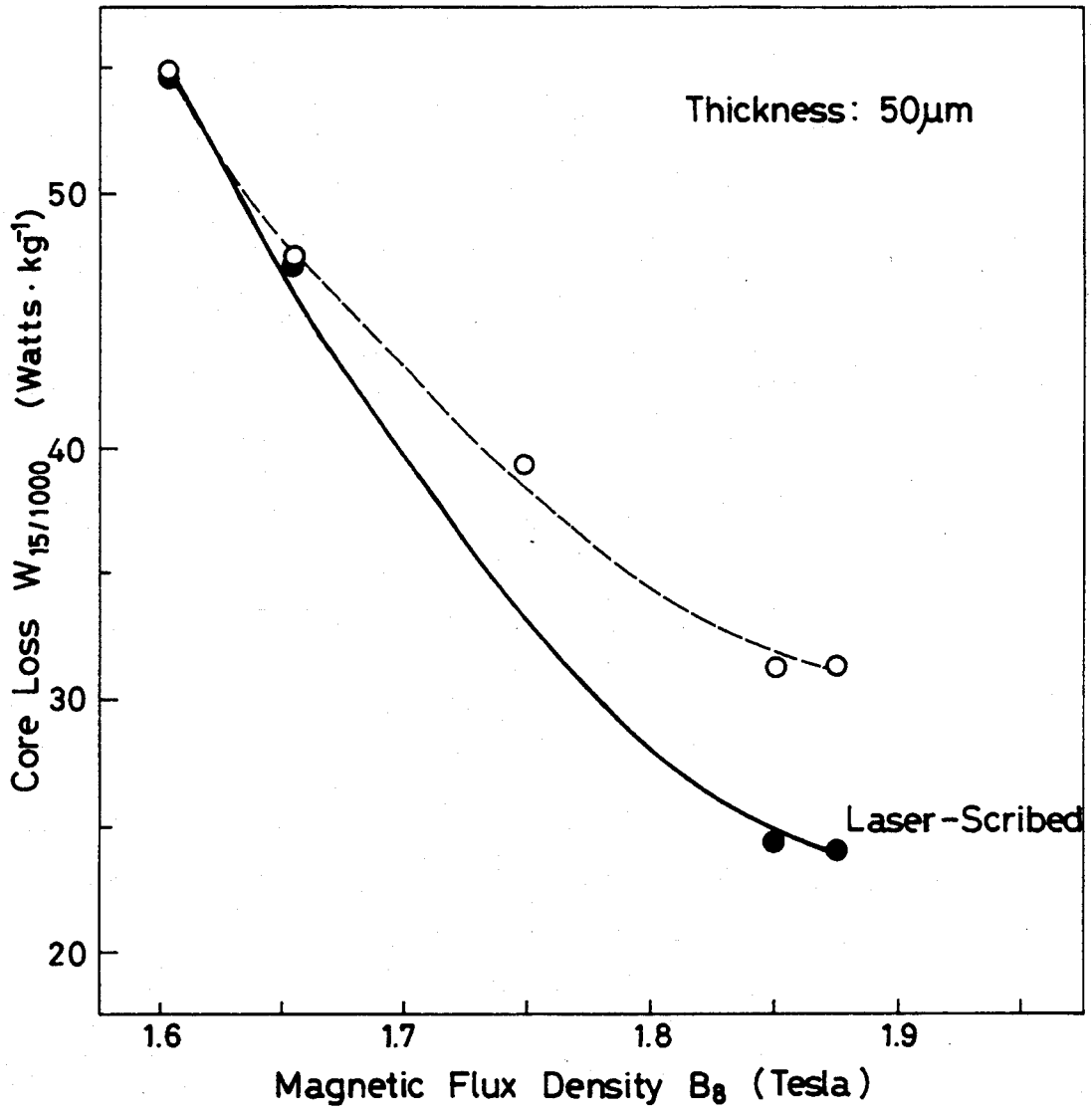
FIG. 1(*a*) is a graph showing the magnetic flux densities and core losses of very thin electrical steel strips produced by various processes.
Figure 1B:
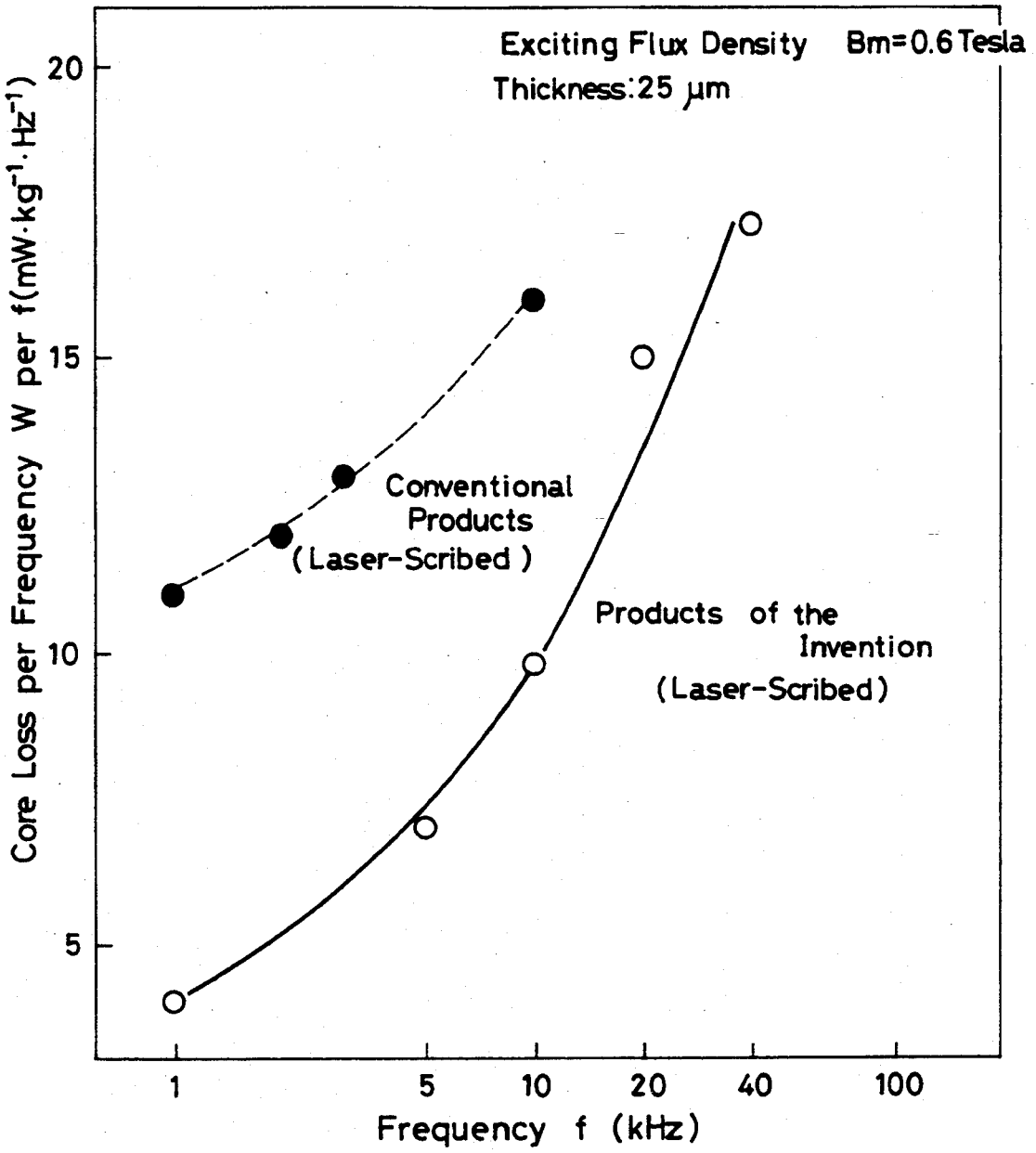
Figure 2:
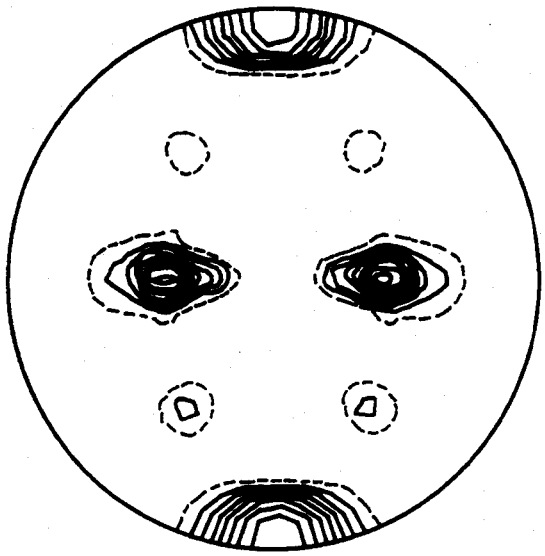
FIG. 2 is a pole figure showing the texture of the product obtained from the experiment from which the discovery on which this invention is based was made.

The invention will now be described in further detail with reference to specific steps of a process for producing a very thin electrical steel strip.

Based on their discovery of the fact that it would be important to use a starting material having a high degree of {110} <001> orientation and reduce the occurrence of nuclei from the grain boundary in order to obtain a product having a high magnetic flux density, the inventors of this invention attempted to produce very thin electrical steel Strips by employing as starting materials grain-oriented electrical steel sheets having different grain diameters and $B8/B_s$ values which were greater than 0.9, cold rolling them at reduction ratios of 60 to 80% to final thicknesses not exceeding 150 microns, and annealing the cold rolled products at temperatures of 700° to 900° C. for primary recrystallization. The inventors determined the magnetic properties of the strips, and found that it would be necessary to use as a starting material a grain-oriented electrical steel strip having a grain diameter $R_D$ of at least 20 mm in the rolling direction in order to obtain a very thin electrical steel strip having a magnetic flux density of at least 1.85 teslas. They also found that the grain diameter $R_C$ of the starting material in the direction (i.e. across the width of the sheet) perpendicular to the rolling direction was a still more important factor and had to be at least 40 mm. They proposed a method for the industrial production of starting materials satisfying those requirements in, for example, Japanese Patent Application laid open under No. 215419/1984.

The inventors also studied the possibility of inhibiting the occurrence of nuclei forming badly oriented grains, from the grain boundary and found that the addition of one or both of Sn and Sb to a grain-oriented electrical steel strip used as the starting material would make it possible to inhibit the occurrence from the grain boundary of nuclei forming grains having a {111} <011> orientation and increase grains having a {110} <001> orientation to thereby yield a product having an improved magnetic flux density.

The inventors' discovery was obtained from the following experiment. They used grain-oriented electrical steel strips containing 3.2% Si, 0.002% C, 0.001% N, 0.002% Al, 0.0004% S, 0.05% Mn, and 0 to 0.5% of one or both of Sn and Sb, all by weight, and having a magnetic flux density ($B_8$ value) of 1.90 T, an average grain diameter of 5 to 40 mm and a thickness of 0.14 mm. They cold rolled them to a final thickness of 30 microns and annealed the cold rolled products at 850° C. for 10 minutes to complete primary recrystallization.

Figure 3:
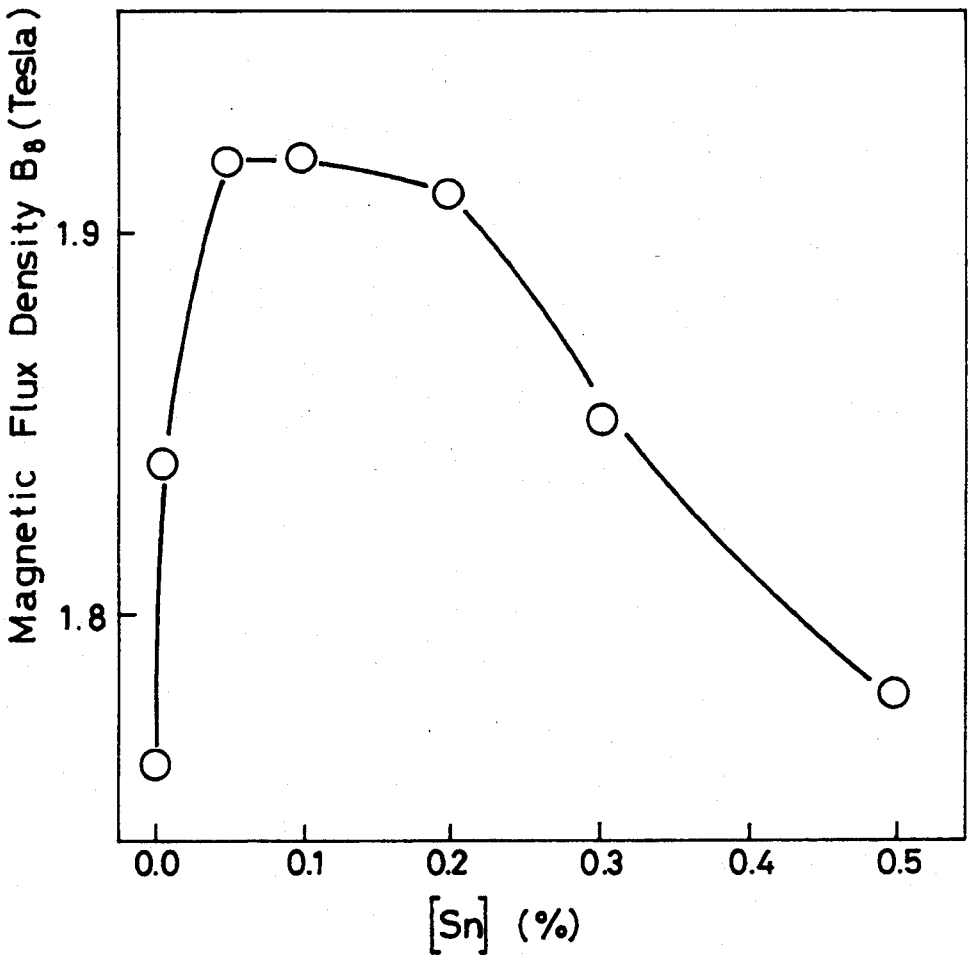
FIG. 3 is a graph showing the magnetic flux densities ($B_8$ values) of very thin electrical steel strips of this invention containing Sn in relation to their Sn contents.

FIG. 3 shows the magnetic flux densities of the products in relation to the tin contents of the starting materials. As is obvious therefrom, the addition of 0.01% or more of Sn made it possible to inhibit the occurrence of nuclei forming grains having a {111} <011> orientation from the grain boundary and thereby obtain a product having an improved magnetic flux density. The addition of over 0.30% of Sn, however, resulted in a product having a low magnetic flux density. This may be due to the fact that the starting material had so small crystal grains and so large a grain boundary area that more nuclei occurred from the grain boundary.

Figure 4:
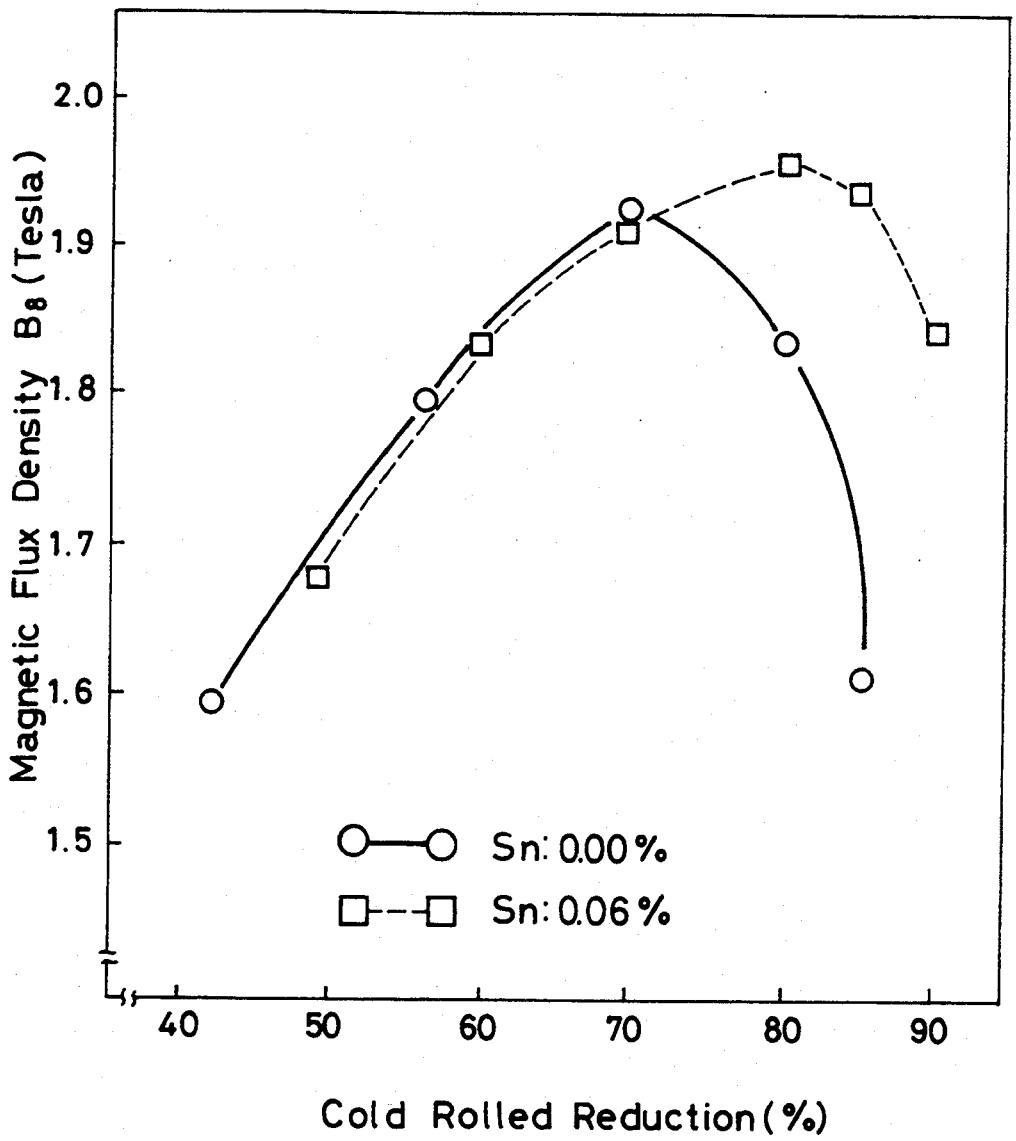
FIG. 4 is a graph showing the magnetic flux densities of strips of this invention containing Sn and not containing Sn in relation to the ratios of cold reduction.

The starting material containing a total of 0.03 to 0.30% of one or both of Sn and Sb yielded a product having a magnetic flux density ($B_8$ value) which was as high as 1.94 teslas, as shown in FIG. 4. The inventors also found that when the starting material contains one or both of Sn and Sb the best cold reduction ratio, at which the product having the highest magnetic flux density could be manufactured, shifted to a higher reduction ratio. The addition of Sn or Sb enabled the manufacture of a very thin product without calling for the use of a starting material having a smaller thickness. The addition of Sn or Sb, or both, makes it possible to produce very thin electrical steel strips having different thicknesses from starting materials having the same thickness, since a very wide range of cold reduction ratios can be employed for manufacturing products having a high magnetic flux density from materials containing Sn or Sb, or both, as compared with the range which can be employed for the cold reduction of materials not containing Sn or Sb.

The inventors also found that it was possible to cause the selective formation and growth of grains having a {110} <001> orientation when a cold rolled material was held or gradually heated in a low temperature range before its temperature was raised to complete primary recrystallization.

C. G. Dunn reported in Acta. Met., 1 (1953), page 163 that a product having a low magnetic flux density (as determined by means of torque) had resulted from preliminary low-temperature annealing at 550° C. followed by annealing at 980° C. The present inventors, however, made a detailed study of the conditions for primary recrystallization annealing, and found that, though a long time of annealing at a low temperature causes the formation and growth of grains having a {111} <011> orientation, as well as ones having a {110} <001> orientation, and thereby yields a product having a low magnetic flux density, the restriction of low-temperature annealing to a period of time within which primary recrystallization is not completed makes it possible to cause the formation of only grains having a {110} <001> orientation and obtain a product having a high magnetic flux density if the temperature is thereafter raised to cause the growth of the grains.

Figure 5:
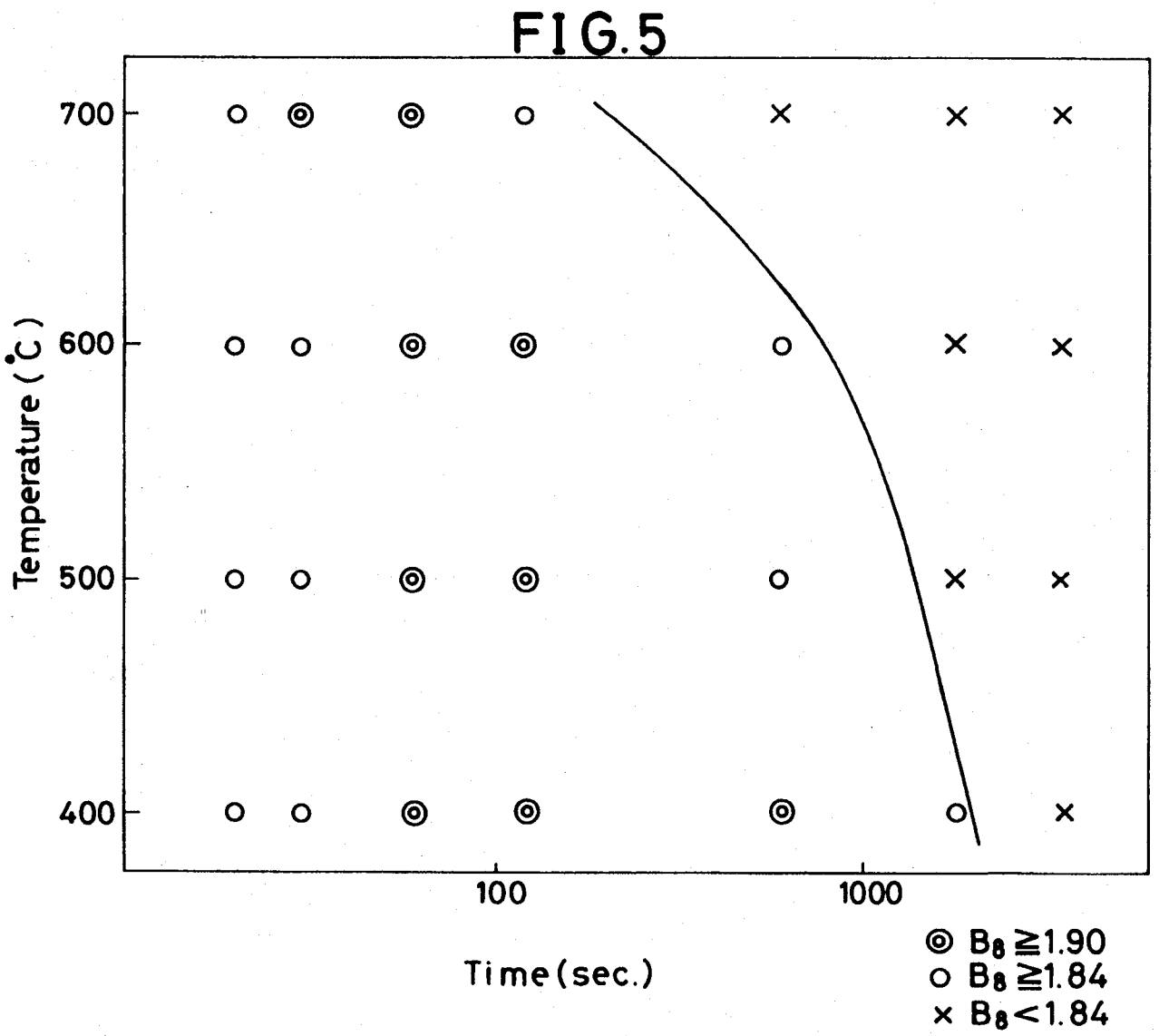
FIG. 5 is a graph showing the magnetic flux densities of the products obtained from the experiment as hereinabove described, in relation to the temperature and time as employed for primary recrystallization annealing.

Reference is made to FIG. 5 showing the magnetic flux densities ($B_8$ values) of very thin electrical steel strips in relation to the conditions of low-temperature annealing which were employed for producing the strips. The strips were produced from grain-oriented electrical steel strips containing 3.3% Si, 0,002% C, 0.001% N, 0.002% Al, 0.002% S and 0.13% Mn, the balance thereof substantially being iron, and having a magnetic flux density ($B_8$ value) of 1.92 T, an average grain diameter of 40 mm and a thickness of 0.17 mm. The sheets were cold rolled to a final thickness of 0.05 mm (50 microns), and the cold rolled products were annealed at temperatures of 400° to 700° C. for one to 30 minutes, and at 850° C. for 10 minutes to complete primary recrystallization. It is obvious from FIG. 5 that very thin electrical steel strips having a high magnetic flux density can be produced when low-temperature annealing is carried out at a temperature T of 400° to 700° C. for a period of time t which is equal to, or longer than, 20 seconds, and is shorter than $(-6T(°C.)+4400)$ seconds, and is followed by temperature elevation to complete primary recrystallization.

Figure 6:
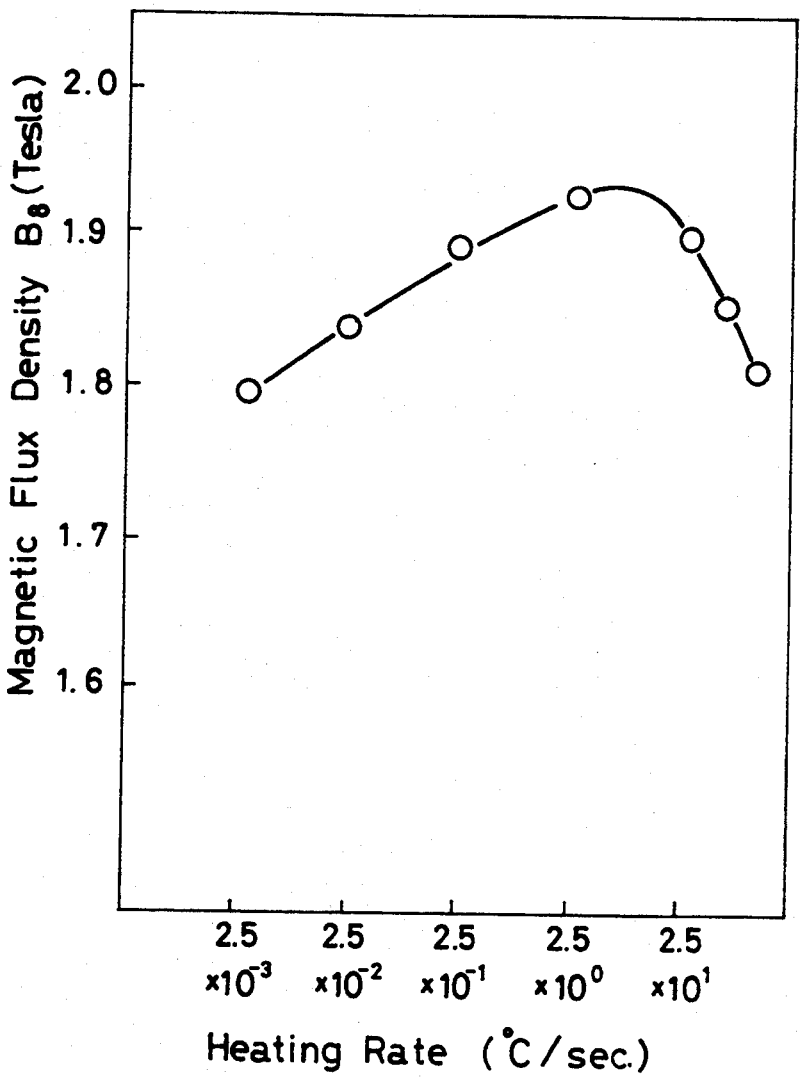
FIG. 6 is a graph showing the magnetic flux densities of strips having different cold reduction ratios and final thicknesses in relation to the heating rate as employed for primary recrystallization annealing.

Cold rolled strips of the same nature were annealed by heating to 850° C. at different rates of $2.5\times10^{-3}$° C. to $1.0\times10^{2}$° C. per second, and holding at 850° C. for 10 minutes. FIG. 6 shows the magnetic flux densities ($B_8$ values) of the products in relation to the heating Fate. As is ovbious therefrom, it is possible to make a product having a high magnetic flux density as defined in accordance with this invention by a $B_8/B_s$ ratio which is greater than 0.9, if the heating rate which is employed for the annealing of a cold rolled product lies within the range of $5.0\times10^{-2}$° C. to $5.0\times10^{0}$° C. per second. It will be noted that these conditions turn out to be equal to the temperature and time conditions shown in FIG. 5.

The use of a starting material having a large grain diameter and a high {110} <001> grain orientation, the addition of one or both of Sn and Sb to the starting material, and the low-temperature annealing performed for a certain length of time prior to the completion of primary recrystallization make it possible to inhibit the formation and growth of grains having a {111} <011> orientation from the grain boundary, which results in the manufacture of a product having a low magnetic flux density, and achieve the selective formation and growth of grains having a {110} <001> orientation, as hereinabove stated. It is needless to say that the process in which those features are incorporated ensures the production of very thin electrical steel strips having a still higher magnetic flux density.

Figure 7:
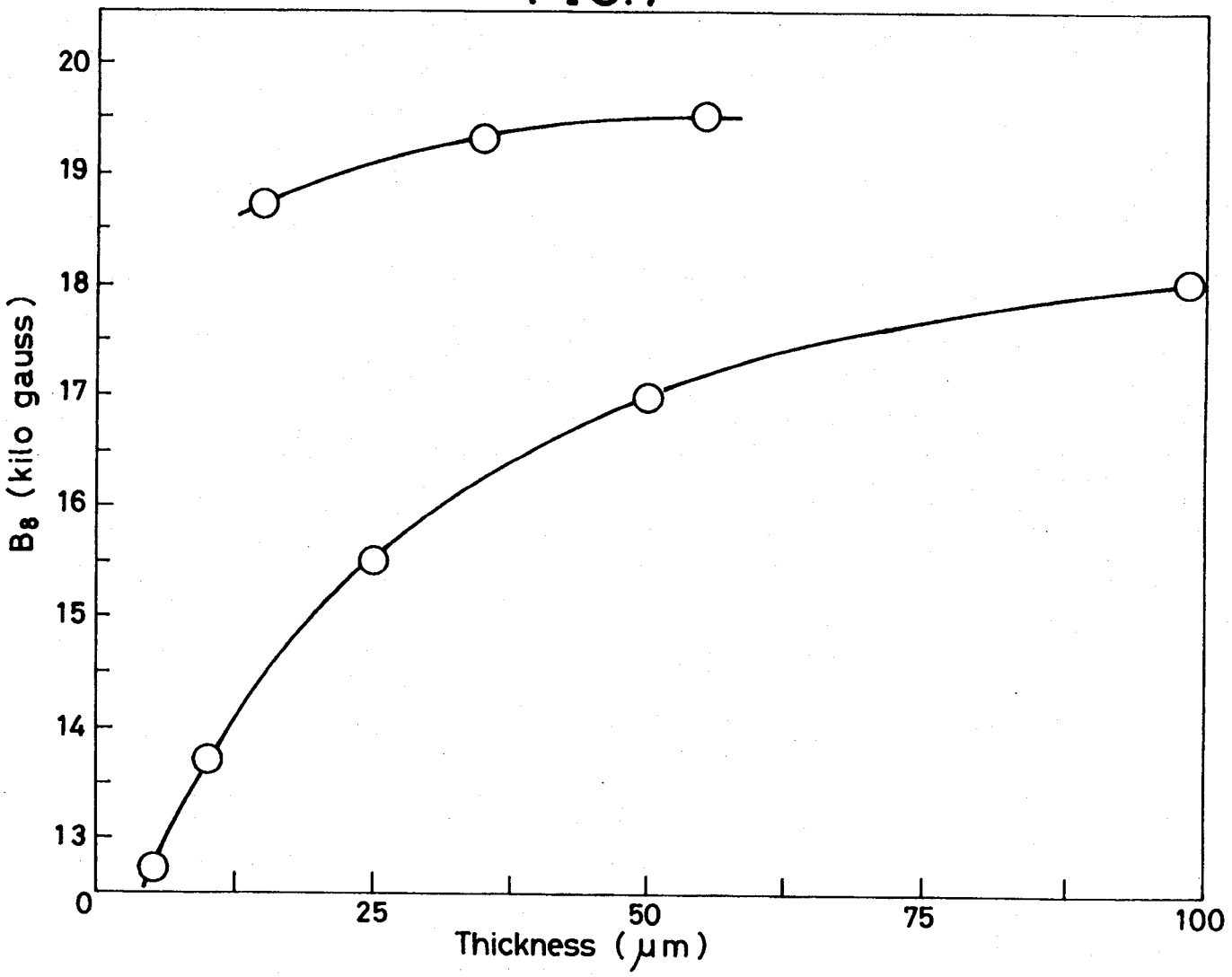
FIG. 7 is a graph showing the magnetic flux densities ($B_8$ values) of products of this invention and conventional products in relation to their thicknesses.

Thus, this invention provides a very thin electrical steel strip having a magnetic flux density which is by far higher than that of any conventional product, as shown in FIG. 7.

It is possible to use any grain-oriented electrical steel strip having a {110} <001> texture as the starting material for the strip of this invention, irrespective of the process which is employed for making the strip. It is possible to use, for example, a grain-oriented electrical steel strip as produced by any of the processes disclosed in Japanese Patent Publications Nos. 3651/1955, 15644/1965 and 13469/1976 and still used on an industrial basis, as hereinbefore stated, or one produced by cold rolling and annealing a rapidly cooled strip of 4.5% Si-Fe steel as disclosed by Arai et al. in Met. Trans., A17 (1986), page 1295. The starting material for the strip of this invention may have a silicon content not exceeding 8%. A material having a silicon content exceeding 8% has a saturation magnetic flux density of 1.7 T or below which makes it unsuitable as a magnetic material, and is also likely to crack when it is cold rolled. A material having a silicon content of 2 to 4% is preferred, as it has a saturation magnetic flux density which is as high as at least 1.95 T, and a high degree of cold workability. The material may contain impurities, such as Mn, Al, Cr, Ni, Cu, W and Co.

The starting material is cold rolled after its glass film is removed, and the cold rolled material is annealed for primary recrystallization in an atmosphere having a composition and a dew point which do not cause any oxidation of iron. The atmosphere may consist of an inert gas such as nitrogen, argon, etc., or hydrogen, or a mixture of an inert gas and hydrogen. Then, an insulating film as disclosed in, for example, Japanese Patent Publication No. 28375/1978 is formed on a very thin electrical steel strip.

EXAMPLES

EXAMPLE 1

Grain-oriented electrical steel strips containing 3.3% Si, 0.1% Mn, 0.001% C, 0.002% N, 0.002% Al and 0.001% S, the balance thereof substantially being iron, and having a $B_8$ value of 1.98 T, a grain diameter $R_D$ of 45 mm, a grain diameter $R_C$ of 500 mm and a thickness of 170 microns, which is produced by the method disclosed in Japanese Patent Application laid open under No. 215419/1984, were pickled for the removal of glass films, and were cold rolled to a final thickness of 50 microns. Then, they were annealed at 800° C. for two minutes in a hydrogen atmosphere, followed by annealing in a nitrogen atmosphere for the formation of insulating films.

Figure 8:
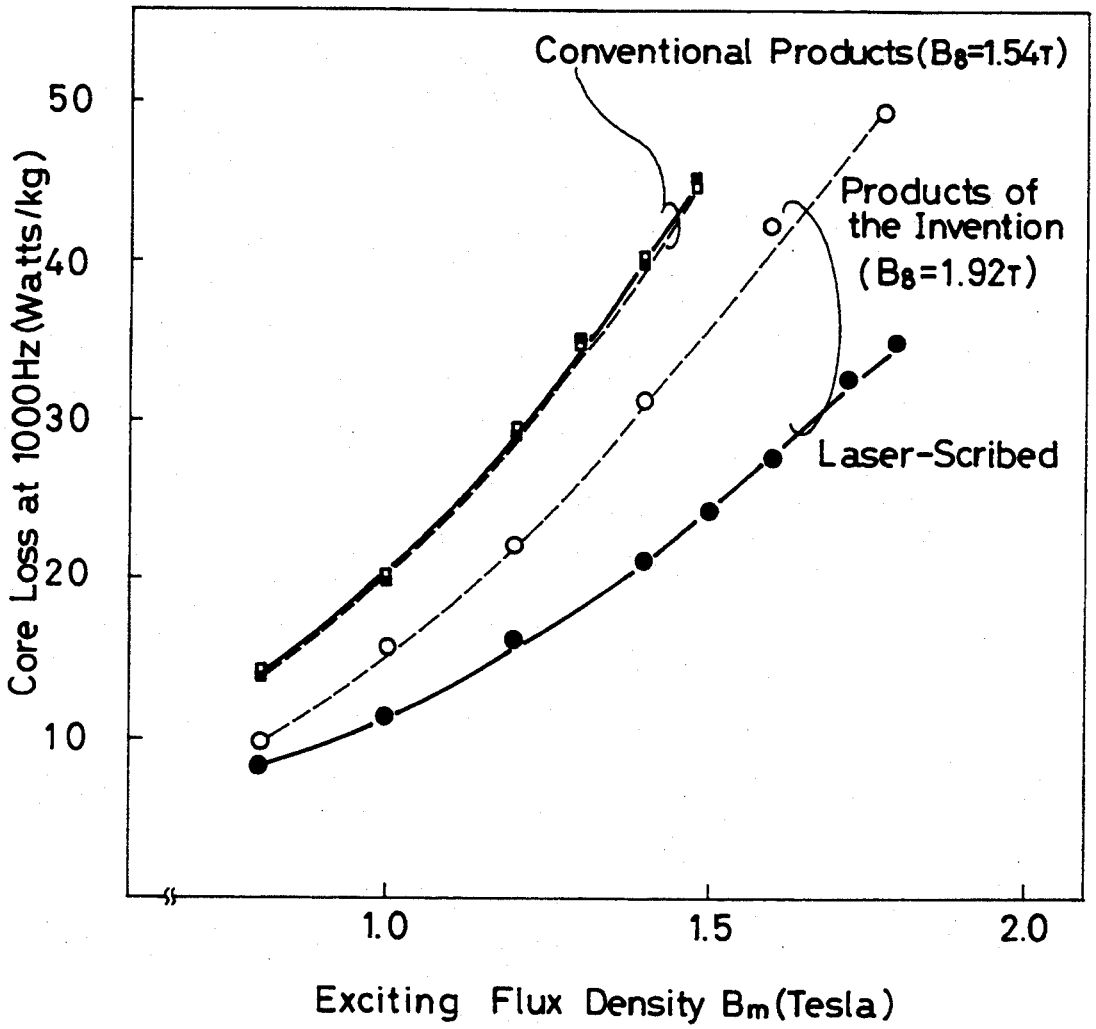
FIG. 8(*a*) is a graph showing the core losses of products of this invention as compared with the conventional products at 1000 Hz in relation to exciting flux density.
Figure 8:
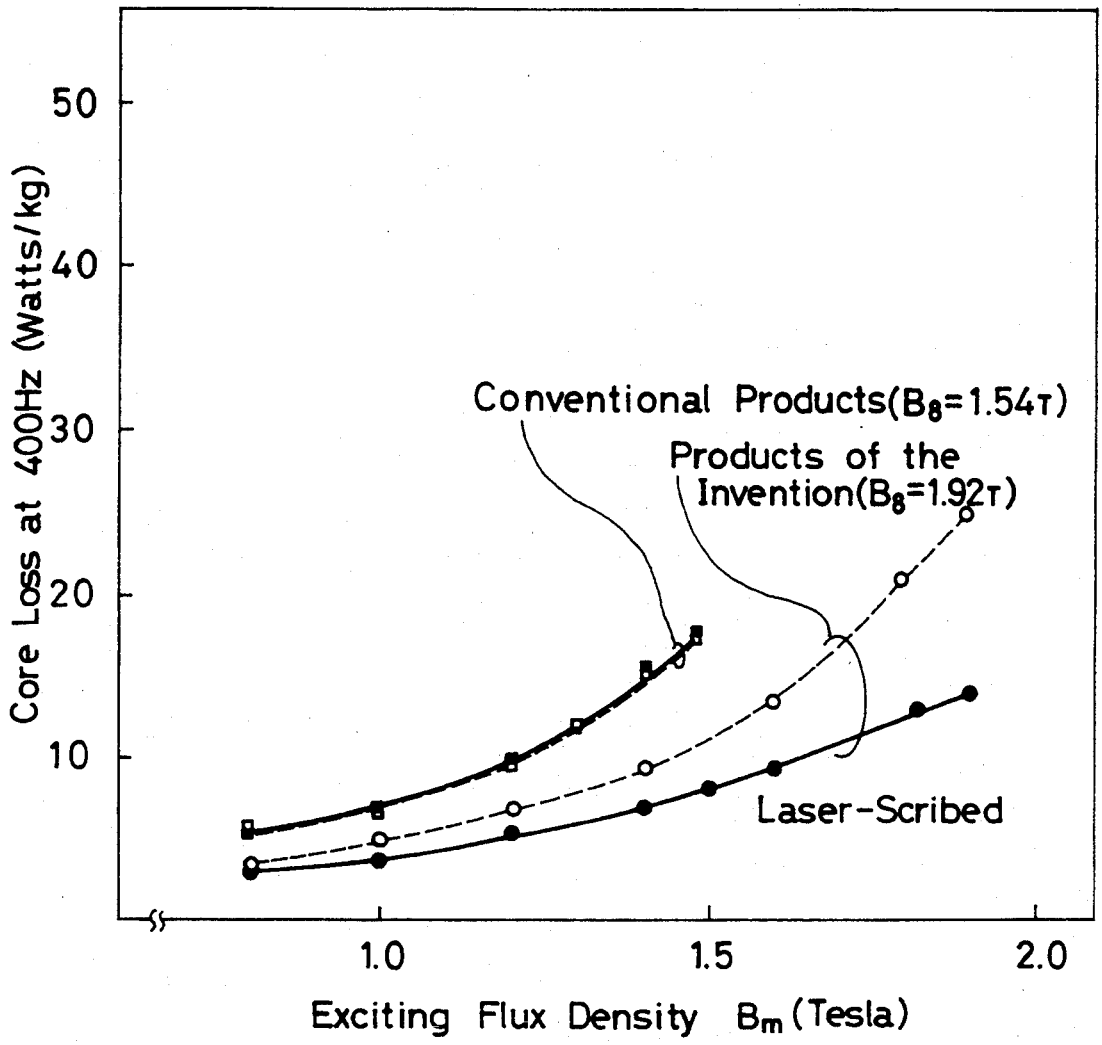

The products were subjected to magnetic domain refining treatment by laser scribing. FIGS. 8(*a*) and 8(*b*) show the magnetic properties of the products as annealed and as laser scribed at the frequencies of 1000 Hz and 400 Hz, respectively. As is obvious therefrom, the products of this invention showed by far lower core losses than the conventional products. At the frequency of 400 Hz and a magnetic flux density of 1.5 T, for example, the product of this invention showed a core loss of 11 W/kg and the laser-scribed product thereof showed a core loss of only 8 W/kg, while the conventional product showed a core loss of 15 W/kg.

It is particularly to be noted that there has hitherto not been available any data showing the core loss of any similar product at an exciting flux density which is as high as 1.7 T. The product of this invention can be used in such a high excitation range showing a very low core loss.

EXAMPLE 2

The same cold-rolled strips as obtained in Example 1 were annealed at 800° C. for two minutes and then at 1200° C. for 10 hours in a hydrogen atmosphere. Then, the insulating film forming and magnetic domain refining treatments of Example 1 were repeated, and the magnetic properties of the products were examined. The results were as shown below:

$B_8$: 2.02 T
$W_{15/400}$: 6.5 W/kg
$W_{17/400}$: 8.5 W/kg
$W_{19/400}$: 12.5 W/kg
$W_{15/1000}$: 20 W/kg
$W_{17/1000}$: 27 W/kg

Figure 9A:
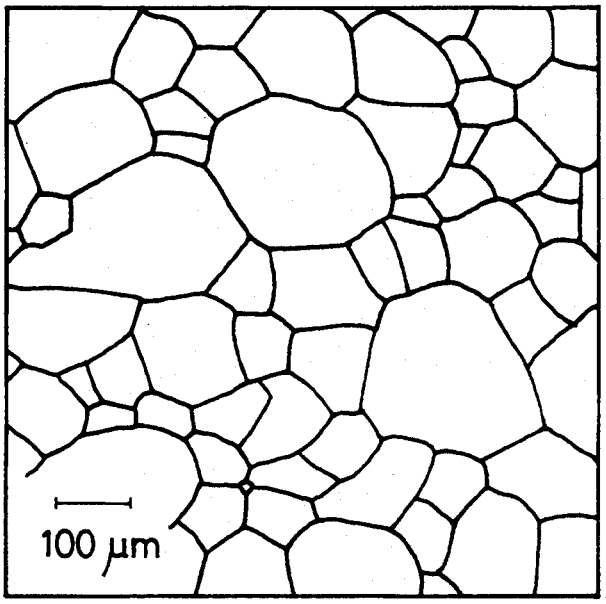
FIGS. 9(*a*) and 9(*b*) show the grain structure of the materials according to Example 2 of this invention as annealed at 800° C. and 1000° C., respectively.
Figure 9B:
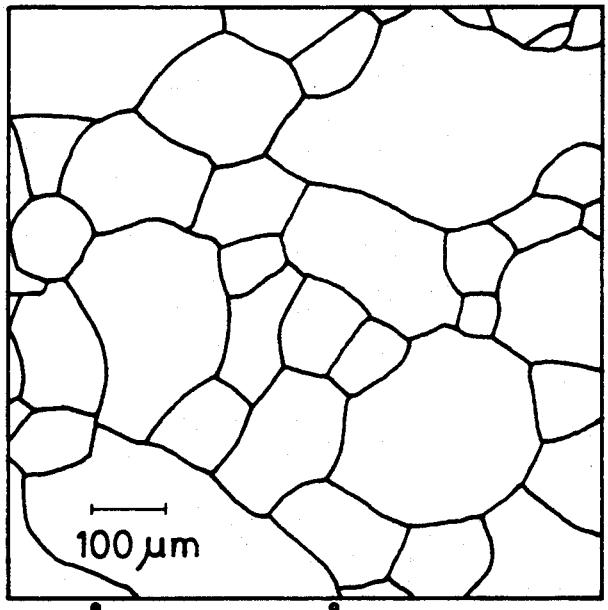
Figure 10A:
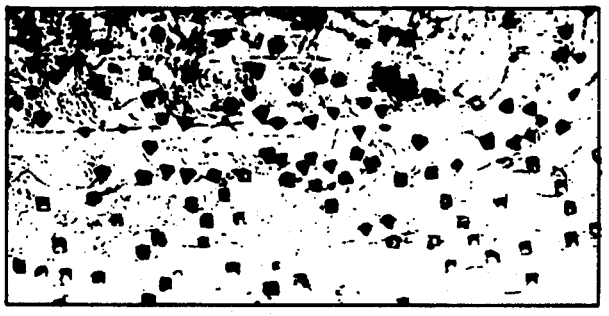
FIGS. 10(*a*) and 10(*b*) are a photograph showing the orientation of primary recrystallization grains formed in the vicinity of the grain boundary of the starting material which were revealed by etch pits, and a model diagram prepared from the photograph, respectively.
Figure 10B:
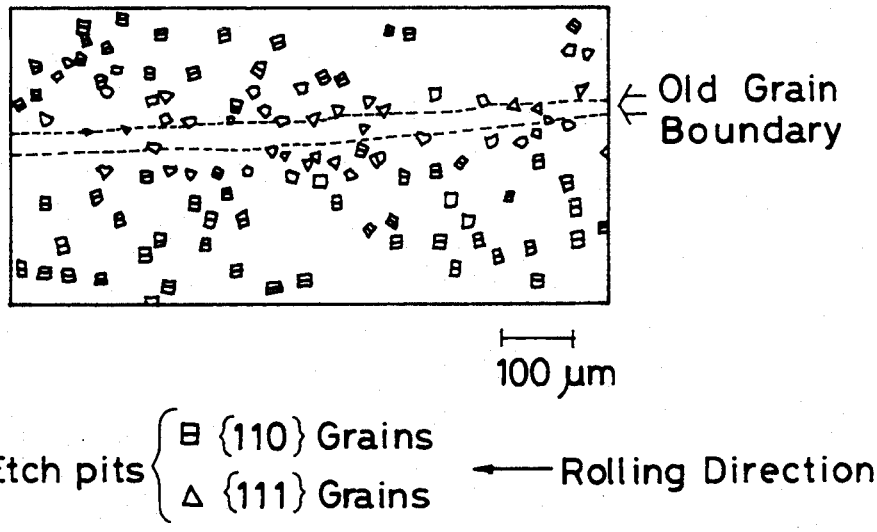

FIGS. 9(*a*) and 9(*b*) show the textures of the materials as annealed at 800° C. and 1200° C., respectively. The material as annealed at 800° C. had an average grain diameter of about 50 microns, and the material as further annealed at 1200° C. had its average grain diameter grown to nearly 100 microns.

EXAMPLE 3

A grain-oriented electrical steel strip containing 3.0% Si, 0.06% Mn, 0.003% C, 0.002% N, 0.001% Al, 0.001% S and 0.07% Sn, the balance thereof substantially being iron, and having a $B_8$ value of 1.88 T, a grain diameter $R_D$ of 5 mm, a grain diameter $R_C$ of 3 mm and a thickness of 230 microns was pickled for the removal of a glass film, and was cold rolled to a final thickness of 50 microns. Then, it was annealed at 850° C. for 10 minutes in an atmosphere comprising 25% $N_2$ and 75% $H_2$. The product had a magnetic flux density or $B_8$ value of 1.91 T.

EXAMPLE 4

Two kinds of grain-oriented electrical steel strips containing 3.0 to 3.3% Si, having tin (Sn) contents of 0.00% and 0.06%, respectively, and having a magnetic flux density ($B_8$ value) of 1.90 to 1.92 T were employed as the starting materials. One half of the starting materials had an average grain diameter of 2 to 20 mm, while the other half had an average grain diameter of 40 to 60 mm. They were cold rolled at a reduction ratio of 75% to a thickness of 50 microns. Then, they were annealed at 850° C. for 10 minutes in a hydrogen atmosphere. The magnetic properties of the products are shown in Table 2.

TABLE 2

| Sn content (%) | Average grain diameter (mm) | Magnetic flux density (T) | Remarks |
|---|---|---|---|
| 0.00 | 2 to 20 | 1.78 | Comparison |
| 0.00 | 40 to 60 | 1.91 | Invention |
| 0.06 | 2 to 20 | 1.91 | " |
| 0.06 | 40 to 60 | 1.93 | " |

EXAMPLE 5

Two kinds of grain-oriented electrical steel strips containing 3.0 to 3.3% Si, having tin (Sn) contents of 0.00% and 0.06%, respectively, and having a magnetic flux density ($B_8$ value) of 1.90 to 1.92 T were employed as the starting materials. One half of the starting materials had an average grain diameter of 2 to 20 mm, while the other half had an average grain diameter of 40 to 60 mm. They were cold rolled at a reduction ratio of 75% to a final thickness of 50 microns Then they were annealed in a hydrogen atmosphere at 500° C. for five minutes and then at 900° C. for 10 minutes to complete primary recrystallization. The magnetic properties of the products are shown in Table 3.

TABLE 3

| Sn content (%) | Average grain diameter (mm) | Magnetic flux density (T) | Remarks |
|---|---|---|---|
| 0.00 | 2 to 20 | 1.88 | Invention |
| 0.00 | 40 to 60 | 1.93 | " |
| 0.06 | 2 to 20 | 1.94 | " |
| 0.06 | 40 to 60 | 1.95 | " |

EXAMPLE 6

A grain-oriented electrical steel strip containing 0.1% Mn, 0.002% C, 0.002% N, 0.01% Al and 0.002% S, the balance thereof substantially being iron, and having a $B_8$ value of 2.01 T, a grain diameter $R_D$ of 12 mm, a grain diameter $R_C$ of 8 mm and a thickness of 500 microns was used as a starting material. It was a produced by the process disclosed in Japanese Patent Application No. 82236/1989 filed in the name of the assignee of this invention. It was pickled for the removal of a glass film, and was cold rolled to a final thickness of 150 microns. Then, it was annealed in a hydrogen atmosphere at 550° C. for five minutes and then at 850° C. for 10 minutes to complete primary recrystallization. The product had a magnetic flux density ($B_8$ value) of 1.99 T.

EXAMPLE 7

A grain-oriented electrical steel strip containing 3.2% Si, 0.05% Mn, 0.002% C, 0.001% N, 0.002% Al, 0.001% S and 0.02% Sb, the balance thereof substantially being iron, and having a $B_8$ value of 1.89 T, a grain diameter $R_D$ of 6 mm, a grain diameter $R_C$ of 6 mm and a thickness of 280 microns was pickled for the removal of a glass film, and was cold rolled to a final thickness of 60 microns. Then, it was annealed at 800° C. for five minutes in an atmosphere consisting solely of hydrogen. The product had a magnetic flux density ($B_8$ value) of 1.89 T.

INDUSTRIAL UTILITY

The product of this invention has the following advantages:

(1) If it contains e.g. 3% Si, it has a magnetic flux density at an exciting force of 800 A/M of 1.84 to 1.95 T which is higher than that of the conventional product by as much as about 0.2 to 0.4 T; and (2) It has a very low core loss. For example, its $W_{15/400}$ value is only about 50% of the cope loss of the conventional product. Moreover, it has a low core loss not known in the past even in a high excitation range exceeding 1.5 T.

The product of this invention, therefore, has a high degree of utility in the realization of smaller and more efficient transformers, particularly high frequency power source transformers. It also provides a great deal of benefit when applied to control devices.

What is claimed is:

1. An electrical steel strip having (1) a silicon content of not more than 8% and from 0.005 to 0.30% of at least one of tin and antimony, the balance thereof substantially being iron, (2) an average grain diameter of not more than 1.0 mm, (3) texture grains having a {110} <001> orientation, (4) a thickness of not more than 150 μm, and (5) a normalized magnetic flux density as expressed by a $B_8/B_s$ value which is greater than 0.9.

* * * * *